United States Patent [19]

Umaba et al.

[11] 4,346,012

[45] Aug. 24, 1982

[54] POWDERY FIRE-EXTINGUISHING AGENT, AND PROCESS FOR ITS PREPARATION

[75] Inventors: Toshihiko Umaba, Takaishi; Tadashi Ito, Osaka, both of Japan

[73] Assignees: Dainippon Ink & Chemicals, Inc., Tokyo; Miyata Industry Company Limited, Kanagawa, both of Japan

[21] Appl. No.: 149,634

[22] Filed: May 14, 1980

[30] Foreign Application Priority Data

May 15, 1979 [JP] Japan ..... 54-58693

[51] Int. Cl.[3] ..... A62D 1/06; B05D 7/24

[52] U.S. Cl. ..... 252/7; 169/47; 427/221; 523/207

[58] Field of Search ..... 252/7, 382, 604, 606; 169/47; 560/83; 427/221

[56] References Cited

U.S. PATENT DOCUMENTS

| | | | |
|---|---|---|---|
| 2,597,702 | 5/1952 | Benning | 260/955 |
| 2,901,428 | 8/1959 | Schulenburg | 252/7 |
| 3,214,372 | 10/1965 | Lobos | 252/7 |
| 3,504,016 | 3/1970 | Smeltz | 560/83 X |
| 4,042,521 | 8/1977 | Dunn | 252/7 X |

FOREIGN PATENT DOCUMENTS

| | | | |
|---|---|---|---|
| 45-3040 | 2/1970 | Japan | 252/7 |
| 46-35917 | 10/1971 | Japan | 252/7 |
| 51-27227 | 8/1976 | Japan | 422/42 |
| 604560 | 4/1978 | U.S.S.R. | 252/7 |

OTHER PUBLICATIONS

High Polymers, vol. XXV, "Fluoropolymers", Edited by Leo A. Wall, Wiley-Interscience, 1972, pp. 551, 208, 236–238, 311, 312 and 444.

*Primary Examiner*—Richard D. Lovering
*Attorney, Agent, or Firm*—Sherman & Shalloway

[57] ABSTRACT

A powdery fire-extinguishing agent containing a powder as main ingredient and a powder as adjuvant, both or one of said powders being treated with an organofluorine compound which has a fluoroalkyl group containing 3 to 20 carbon atoms, which has a major transition temperature of 20° C. or higher and a fluorine content of 5% by weight or more, which is insoluble in water and insoluble or sparingly soluble in a combustible liquid, and which has oil repellency; and a process for preparation thereof.

4 Claims, No Drawings

POWDERY FIRE-EXTINGUISHING AGENT, AND PROCESS FOR ITS PREPARATION

This invention relates to a powdery fire-extinguishing agent having the ability to extinguish fire rapidly and having the effect of accumulating, thus being capable of preventing reignition after extinguishment of fire, and also relates to a process for preparing said agent.

Currently, there are various fire-extinguishing agents, such as powdery agents, foaming agents, liquid agents and gaseous agents, which are used according to the type of fire. Of these fire-extinguishing agents, powdery agents are widely used since they have a high fire-extinguishing capacity, permit reduction in the volume of a fire extinguisher containing the agent, and can extinguish fire rapidly no matter what the type of fire is. Powdery fire-extinguishing agents, however, are defective in that they cannot prevent reignition in fire involving oils. This is because powdery fire-extinguishing agents, unlike foaming fire-extinguishing agents, have no ability to accumulate on liquid combustible matter and shut off air. When powdery fire-extinguishing agents are used, therefore, fire extinction is performed only partially, and if the source of fire remains, reignition will occur to grow a fire; hence, the use of powdery fire-extinguishing agents arouses the need to put out the fire of burning matter instantaneously. Foaming fire-extinguishing agents, on the other hand, can prevent reignition because of its accumulating effect, but have no capacity of extinguishing fire rapidly. The current fire-extinguishing tactics, therefore, lies in the joint use of a powdery fire-extinguishing agent and a foaming fire-extinguishing agent. Even this method involves difficult procedures, costs much in equipments, is uneconomical, has low maneuverability, and is inefficient.

With this situation considered, fluorine-treated powdery fire-extinguishing agents were invented which are capable of preventing reignition of the liquid combustible matter by floating on the liquid combustible matter to form a barrier layer which shields the liquid combustible matter from air to prevent the evaporation of the liquid combustible matter. Such powdery fire-extinguishing agents are described in Canadian Pat. No. 940130.

The fluorine compounds described in said Canadian patent are surface active agents. The powdery fire-extinguishing agents treated with such fluorine compounds have the tendency, after long-term storage, to agglomerate due to moisture in the air and decrease in fluidity. When used together with water or a fire-extinguishing agent containing water, the powdery fire-extinguishing agent treated with the fluorinated surfactant forms masses under the action of water. In this situation, the powdery fire-extinguishing agent can no longer float on a liquid combustible material, such as petroleum, gasoline, or alcohol, to form a barrier layer. Furthermore, the fluorinated surfactant-treated powdery fire-extinguishing agent is unable to rest on an alcohol such as methanol or ethanol, and thus, is ineffective against the fire of such a liquid combustible material.

It is not known when a fire breaks out, and a wide variety of combustible materials are present. Therefore, fire-extinguishing agents have been desired which can be stored for long periods of time and which are effective against many types of fires.

Accordingly, the object of the present invention is to provide a powdery fire-extinguishing agent which has no hygroscopicity, shows a good flowability even after long-term storage, forms no lumps upon contact with water, and floats on a hydrophilic combustible liquid such as alcohol to form a barrier layer.

According to the present invention, there is provided a powdery fire-extinguishing agent attaining said object, which comprises a powder as main ingredient (to be referred to as main powder) and a powder as an adjuvant (to be called adjuvant powder), both of or one of said powders being treated with an organofluorine compound having a fluoroalkyl group containing 3 to 20 carbon atoms, having a major transition temperature of 20° C. or higher and a fluorine content of 5% by weight or more, being insoluble in water and insoluble or difficultly soluble in a combustible liquid, and having oil repellency.

The main powder in the powdery fire-extinguishing agent of the present invention may be any compound which generates a non-combustible gas such as carbon dioxide gas or ammonia gas upon heat decomposition by fire or which acts as a negative catalyst for combustion. Examples of such compound include sodium hydrogencarbonate, potassium hydrogencarbonate, ammonium sulfate, ammonium dihydrogen phosphate, potassium chloride, sodium chloride, barites, diammonium hydrogen phosphate, and mixtures of them with aluminum sulfate and/or aluminum chlorohydrate. They may be used in combination of two or more.

The adjuvant powder is a powder to be mixed with the main powder in order to enhance the fire-extinguishing properties, operating properties, flowability of economy of the powdery fire-extinguishing agent. Examples of the adjuvant powder are white carbon, mica, talc, calcium carbonate and magnesium carbonate for improving flowability; silicone resin, metal soap, and wax for improving moisture resistance; various plastics such as epoxy resin, polyester or melamine resin, sodium polyacrylate, carboxymethylcellulose, perlite, vermiculite and hollow glass beads, intended for lowering specific gravity or improving accumulating effect; and urea, borax and thiourea which, upon heat decomposition, foam to enhance accumulating effect.

The organofluorine compound used in the present invention is a non-adhesive compound having a fluoroalkyl group containing 3 to 20, preferably 6 to 12, carbon atoms, being insoluble in water (solubility: less than 1% by weight at 25° C.), having a major transition temperature, i.e. melting point, glass transition point or softening point, of 20° C. or higher, and having a molecular weight, preferably, of about 700 to about 200,000. The organofluorine compound must also contain 5% by weight or more of fluorine in the molecule and have oil repellency. Examples of the organofluorine compound are as follows:

(1) A homopolymer of a vinyl monomer having a fluoroalkyl group containing 3 to 20 carbon atoms or a copolymer of said vinyl monomer with a vinyl monomer containing no fluorine Examples of the vinyl monomer having the fluoroalkyl group are listed below.

$C_7F_{15}CH_2OCOCH{=}CH_2$,
$C_8F_{17}SO_2N(C_3H_7)CH_2CH_2OCOCH{=}CH_2$,
$C_8F_{17}SO_2N(CH_3)CH_2CH_2OCOC(CH_3){=}CH_2$

-continued

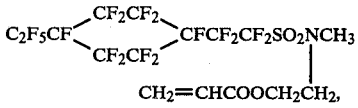

$C_7F_{15}CON(C_2H_3)CH_2CH_2OCOC(CH_3)=CH_2$,
$CF_3(CF_2)_5CH_2CH_2OCOCH=CH_2$,
$CF_3(CF_2)_9CH_2CH_2OCH=CH_2$,
$C_8F_{17}(OH_2)_{11}OCOC(OH_3)=CH_2$, $C_8F_{17}CH_2CH(OH)CH_2OCOC(CH_3)=CH_2$, $(CH_3)_2CFO(CH_2)_5OCOCH=CH_2$, $C_2F_5(OCF_2CF_2)_3OCF_2CF_2CON(CH_3)CH_2CH(CH_2=CHCOO)$, $C_8F_{17}SO_2N(CH_2CH_2OCOCH=CH_2)_2$,
$C_8F_{17}SO_2N(CH_3)(CH_2)_{10}COOCH_2CH=CH_2$,
$C_8F_{17}SO_2N(C_2H_5)CH_2CH_2OCOCH=CHCOOC_4H_9$,
$C_6F_{13}SO_2N(CH_3)CH_2CH_2OCOCH=CH_2$ and
$C_8F_{17}SO_2NHCH_2CH_2SO_2CH=CH_2$.

Examples of the fluorine-free vinyl monomer include ethylene, propylene, butylene, butadiene, isoprene, chloroprene, vinyl chloride, vinylidene chloride, styrene, an ester of (meth)acrylic acid with an alcohol, an amide of (meth)arylic acid with an alkylamine, said alcohol or alkylamine having 20 or less carbon atoms, diacetoacrylamide, N-methylolacrylamide, acrylonitrile, acrylamide, vinyl acetate, and a vinyl compound having a siloxane bond. These monomers may be used in combination of two or more.

Those homopolymers or copolymers can be prepared by a known method of vinyl polymerization. A general example is solution polymerization or emulsion polymerization using a radical initiator. The molecular weight of the polymer can be adjusted to a preferred range by the concentration of the initiator and the concentration and type of a chain transfer agent. Generally, the preferred molecular weight is 3,000 or more.

(2) A (poly)ester having a molecular weight preferably of 1,000 or more, formed between a monohydric or polyhydric alcohol containing 3 to 30 carbon atoms and having a $C_3$–$C_{20}$ fluoroalkyl group and an optionally fluorinated mono- or polycarboxylic acid having 4 to 20 carbon atoms, and a (poly)ester having a molecular weight preferably of 1,000 or more, formed between an optionally fluorinated mono- or polyhydric alcohol having 2 to 20 carbon atoms and a mono- or polycarboxylic acid having 3 to 30 carbon atoms and having a $C_{3-20}$ fluoroalkyl The constituent compounds for use in forming these (poly)esters are, for example, as follows:

$C_9F_{19}CH_2CH_2OH$,
$C_8F_{17}SO_2N(C_3H_7)CH_2CH_2OH$,
$C_8F_{17}SO_2N(CH_2CH_2OH)_2$,
$C_8F_{17}SO_2N(C_2H_5)CH_2CH(OH)CH_2OH$,
$C_7F_{15}COOH$,
$C_8F_{17}SO_2N(C_3H_7)CH_2COOH$, $C_6F_{13}CH_2CH_2CH(COOH)COOH$, benzoic acid, adipic acid, sebacic acid, phthalic acid, maleic acid, trimellitic acid, ethylene glycol monomethyl ether, ethylene glycol, propylene glycol, diethylene glycol, glycerine, polypropylene glycol, 2-ethylhexanol, and stearyl alcohol.

(3) A (poly)urethane having a molecular weight preferably of 700 or more, formed between a $C_{3-30}$ mono- or polyhydric alcohol having a $C_{3-20}$ fluoroalkyl group (the alcohol may, in some cases, incorporate a fluorine-free mono- or polyhydric alcohol) and an organic mono- or polyisocyanate such as phenyl isocyanate, tolylene diisocyanate, diphenylmethane diisocyanate, hexamethylene diisocyanate or polymethylene polyphenylisocyanate.

(4) A homopolymer having a molecular weight preferably of 3,000 or more, derived from an epoxide monomer having a $C_{3-20}$ fluoroalkyl group, such as $(CF_3)_2CFOCH_2CH\text{—}CH_2$, (O)

$(CHF_2)_2CFOCH_2CH\text{—}CHCH_2OCF(CF_3)_2$, (O)

$C_8F_{17}SO_2N(C_2H_5)CH_2CH\text{—}CH_2$ or (O)

$C_7F_{15}CH_2CH\text{—}CH_2$, and (O)

a copolymer having a molecular weight preferably of 3,000 or more, formed between said epoxide monomer and a fluorine-free epoxy compound, preferably, such as propylene oxide, or epichlorohydrin.

Suitably, the oil repellency of the organofluorine compound used in the present invention is 4 or more when measured in the following manner: A woven fabric of polyester is dipped in a solution or dispersion of the organofluorine compound having a concentration of 0.5% by weight. The woven fabric is squeezed to a pickup of 100% (Indicating the absorption of the solution or dispersion in an amount equal to the weight of the woven fabric), and dried for 3 minutes at 170° C. Then, the treated woven fabric is measured by AATCC Test Method 118-1966 to obtain the value of 4 or more (indicative of no penetration of n-tetradecane into the woven fabric).

Preferably, the oil repellency of the organofluorine compound is also expressed as 50 or more when measured in the following manner: The same treated woven fabric is measured by AATCC Test Method 22-1971, Spray Test to obtain the value of 50 or more (indicating that water does not ooze out to the back of the woven fabric).

In the fire-extinguishing agent of the present invention, the amount of the organofluorine compound adhered may be such a minimal amount as will permit the organofluorine compound to show its effects. If it is too large, economy will be sacrificed and the fire-extinguishing properties lowered. Generally, its suitable amount is 0.01 to 10% by weight.

According to the present invention, there is also provided a process for preparing a powdery fire-extinguishing agent treated with an organofluorine compound, which comprises dipping the main powder and/or adjuvant powder of a powdery fire-extinguishing agent in a solution or dispersion of an organofluorine compound having a fluoroalkyl group containing 3 to 20 carbon atoms, having a major transition temperature of 20° C. or higher and a fluorine content of 5% by weight or more, being insoluble in water and insoluble or sparingly soluble in a combustible liquid, and having oil repellency; then drying the powders; and if desired, pulverizing the resulting powders; and further if desired, mixing them with the main powder and/or the adjuvant powder.

When the main powder and/or the adjuvant powder are porous powders, said process tends to cause the organofluorine compound to be adsorbed in a large amount or an amount more than desired, as compared with those powders being non-porous. This is uneconomical in view of the relative expensiveness of the organofluorine compound. According to findings by the present inventors, moreover, the adsorption of the organofluorine compound to the inside of the particles of the porous main powder or adjuvant powder would not afford remarkably excellent effects, as contrasted with the adhesion of the organofluorine compound to their surface only. Therefore, when the main powder and/or the adjuvant powder are porous powders, it is sufficient for only their surface to be treated with the organofluorine compound. An example of a method of preparing such powdery fire-extinguishing agent comprises spraying the porous main powder and/or adjuvant powder with a solution or dispersion of the organofluorine compound by a spray nozzle while stirring and drying those powders; or comprises the drying step after the spraying step. The most preferable method would comprise first saturating the porous main powder and/or adjuvant powder with an inert solvent or water; then dipping the powders in a solution or dispersion of the organofluorine compound; then drying them; and if desired, further pulverizing the dried powders.

It is not necessarily needed that all of the main powder and the adjuvant powder be subjected to the treatment. When the amount of the organofluorine compound used is large, considerable effects can be obtained even by mixing the treated powder with the untreated powder.

Also, the main powder or adjuvant powder treated with a silicone resin or an acrylic resin may be blended with the treated powder of the present invention. Furthermore, prior to or after the treatment of the main powder or adjuvant powder with the organofluorine compound, those powders may be treated with a silicone resin, a metallic soap, or other treating agent.

Of course, in the treatment of the main powder and the adjuvant powder, the organofluorine compound of the present invention may be combined with a non-fluorine type polymer having a major transition temperature of 20° C. or more, such as an acrylic resin, silicone resin, polystyrene or polyester, a natural organic matter such as rosin, or other treating agent.

The powdery fire-extinguishing agent of the present invention is the most suitable agent for extinguishing the fire of a combustible liquid such as gasoline, heavy oil, light oil, n-heptane, alcohol, ketone or ester. This powdery fire-extinguishing agent, especially when it is a porous powder, has a small apparent specific gravity since air inside of the pores is not substituted with a combustible liquid. Therefore, the extinguishant floats well on the surface of the combustible liquid for a long time and scarcely sinks, and thus, has a high accumulating effect. That is, when the powdery fire-extinguishing agent is used, the residue of the powder thermally decomposed during extinction of fire or the powder applied in excess pile as a thick layer on the surface of the combustible liquid, preventing the evaporation of the combustible liquid and simultaneously shutting the liquid off from air. Hence, reignition is inhibited, and even if a fire broke out partially, it would not easily spread.

Also, the powdery fire-extinguishing agent of the present invention, even when stored for a long time, does not cause the agglomeration of the particles that would pose the risk of clogging the ejection nozzle of an extinguisher containing the extinguishant. Even when used jointly with a foaming extinguishant, the powdery extinguishant of the present invention would present no troubles.

Another feature of the powdery fire-extinguishing agent of the present invention is its excellent fluidity which eliminates the need to incorporate other fluidity aides, and its possession of rapid extinguishing ability which is a general feature of a powdery fire-extinguishing agent.

Therefore, the powdery fire-extinguishing agent of the present invention is effective not only against fires involving oils, but also against ordinary fires including fires involving wood, fires involving electricity, and fires involving silane compounds or organic metals such as alkyl aluminums. Furthermore, the powdery fire-extinguishing agent of the present invention not only is used in fire, but can also be scattered over the surface of a liquid in order to protect the liquid from possible fire.

The present invention is described in greater detail by way of Examples in which "parts" are all by weight.

EXAMPLE 1

$C_8F_{17}SO_2N(CH_3)CH_2CH_2OCOC(CH_3)=CH_2$ (70 parts) and 30 parts of stearyl methacrylate were dissolved in 1,000 parts of 1,1,1-trichloroethane, and 1 part of azobisisobutyronitrile as a polymerization initiator and 3 parts of lauryl mercaptan as a polymerization regulator were added. The mixture was stirred for 4 hours at 80° C. to obtain a solution of a copolymer having a molecular weight of about 20,000. The solution was diluted with 1,1,1-trichloroethane to various concentrations. 20 Grams of each of the resulting various-concentration dilutions was mixed with 20 g of ammonium dihydrogen phosphate powder. The resulting mixture was dried at 80° C. for 1 hour and then crushed in a mortar, and sifted through a 30-mesh sieve to obtain a treated powder.

30 Milliliters of a combustible liquid was taken into a sampling bottle with a caliber of 30 mm, and sprayed with 1 g of the treated powder. 30 Minutes later, the degree of the floating of the treated powder (its accumulating effect) was observed. The results are shown in Table 1.

TABLE 1

| | Amount of organofluorine compound adhered (%) | | | | |
|---|---|---|---|---|---|
| Liquid | 0 | 0.075 | 0.75 | 1.5 | 3 |
| Gasoline | X | X | Δ | ○ | ◎ |
| Kerosine | X | X | ○ | ◎ | ◎ |
| Methanol | X | Δ | ○ | ◎ | ◎ |

The marks in the table have the following meanings:
X The powder did not rest on the surface of the liquid but sedimented.
Δ The powder remained in a small amount on the surface of the liquid.
○ A considerable amount of the powder remained on the surface of the liquid.
◎ Almost all of the powder remained on the surface of the liquid.
These marks have the same meanings in the following Examples, too.

In Table 1, the samples whose floating degree or buoyancy is expressed as Δ, ○ and ◎ did not cause ignition even when an open flame was placed 1 cm above the liquid surface.

COMPARATIVE EXAMPLE

For comparison, a fluorine type surfactant, $C_8F_{17}SO_2NHCH_2CH_2CH_2N^+(CH_3)_3I^-$, was dissolved in a mixed solvent consisting of 80 parts of water and 20 parts of acetone. The solution was mixed with ammonium dihydrogen phosphate powder in the same manner as in Example 1 to obtain a treated powder. The treated powder was subjected to the same test as in Example 1, and the results are shown below.

TABLE 2

| Liquid | Amount of fluorine type surfactant adhered (%) 0 | 1 | 3 | 5 |
|---|---|---|---|---|
| Gasoline | X | X | X | Δ |
| Kerosine | X | X | Δ | ○ |
| Methanol | X | X | X | X |

EXAMPLE 2

90 Parts of $C_8F_{17}SO_2N(CH_3)CH_2CH_2OCOCH{=}CH_2$, 10 parts of β-hydroxyethyl methacrylate and 1 part of azobisisobutyronitrile were dissolved in 1,000 parts of benzotrifluoride, and the solution was stirred for 4 hours at 80° C.

The resulting solution of copolymer having a molecular weight of about 30,000 was used to treat ammonium dihydrogen phosphate powder in the same way as in Example 1. The treated powder was subjected to the same test as in Example 1. The results are shown in Table 3.

TABLE 3

| Liquid | Amount of organofluorine compound adhered (%) 0 | 3 | 7.5 |
|---|---|---|---|
| Gasoline | X | ○ | ◎ |
| Kerosine | X | ○ | ◎ |
| Methanol | X | ○ | ◎ |

EXAMPLE 3

585 Parts of $C_8F_{17}SO_2N(C_3H_7)CH_2CH_2OH$, 250 parts of diphenylmethane diisocyanate, and 270 parts of stearyl alcohol were reacted in 5,000 parts of benzotrifluoride for 8 hours at 85° C. with stirring, to obtain a urethane compound. The resulting compound was used to treat ammonium dihydrogen phosphate powder in the same way as in Example 1. The treated powder was subjected to the same test as in Example 1. The results are shown in Table 4.

TABLE 4

| Liquid | Amount of organofluorine compound adhered (%) 0 | 1 | 3 | 5 |
|---|---|---|---|---|
| Gasoline | X | Δ | ○ | ◎ |
| Kerosine | X | ○ | ◎ | ◎ |
| Methanol | X | ○ | ◎ | ◎ |
| Acetone | X | Δ | Δ | ○ |
| Toluene | X | ○ | ○ | ◎ |
| n-Heptane | X | Δ | ○ | ◎ |

EXAMPLE 4

63 Parts of $C_8F_{17}SO_2N(CH_3)CH_2CH_2OCOCH{=}CH_2$, and 7 parts of 2-ethylhexyl methacrylate were emulsion-polymerized with the use of 1 part of a cationic emulsifying agent, Ethomeen T-15 Acetate (a product of The Lion Fat and Oil Co., Ltd.) The resulting copolymer emulsion was diluted with water. Sodium hydrogencarbonate powder was treated with the resulting dilution in the same way as in Example 1, and the treated powder was examined for buoyancy on a combustible liquid in the same way as in Example 1. The results are shown in Table 5.

TABLE 5

| Liquid | Amount of organofluorine compound adhered (%) 0 | 1 | 3 | 5 |
|---|---|---|---|---|
| Gasoline | X | ○ | ◎ | ◎ |
| Kerosine | X | ○ | ◎ | ◎ |
| Methanol | X | ◎ | ◎ | ◎ |

EXAMPLE 5

70 Parts of $C_{10}F_{21}CH_2CH_2OCOCH{=}CH_2$, 25 parts of benzyl methacrylate, 5 parts of diacetone acrylamide, and 1 part of azobisisobutyronitrile were dissolved in 400 parts of 1,1,1-trichloroethane. The solution was stirred for 8 hours at 85° C. to obtain a terpolymer solution. Potassium hydrogencarbonate powder was treated with the resulting solution in the same way as in Example 1. The treated powder was examined for buoyancy in the same way as in Example 1. The results are shown in Table 6.

TABLE 6

| Liquid | Amount of organofluorine compound adhered (%) 0 | 1 | 3 |
|---|---|---|---|
| Gasoline | X | Δ | ○ |
| Acetone | X | Δ | ○ |
| Methanol | X | ○ | ◎ |

EXAMPLE 6

The copolymer (organofluorine compound) solution formed in Example 1 was blended with a main powder/adjuvant powder mixture, and the resulting blend was dried for 2 hours at 80° C. to obtain the following treated powders No. 1 to 7 whose composition is expressed in a dry weight ratio. The main powder/adjuvant powder mixture had previously been immersed in toluene to absorb the toluene as much as possible, whereafter the mixture was blended with the copolymer solution.

| | |
|---|---|
| Treated powder No. 1 | |
| Sodium hydrogen carbonate | 100 parts |
| White carbon | 4 parts |
| Organofluorine compound | 1 parts |
| Treated powder No. 2 | |
| Potassium hydrogencarbonate | 100 parts |
| White carbon | 4 parts |
| Organofluorine compound | 1 parts |
| Treated powder No. 3 | |
| Ammonium dihydrogen phosphate | 100 parts |
| White carbon | 4 parts |
| Organofluorine compound | 1 parts |
| Treated powder No. 4 | |
| Potassium chloride | 100 parts |
| White carbon | 4 parts |
| Organofluorine compound | 1 parts |
| Treated powder No. 5 | |
| Ammonium dihydrogen phosphate | 100 parts |

-continued

| | |
|---|---|
| Polyester powder | 10 parts |
| Talc | 4 parts |
| Organofluorine compound | 1 parts |
| Treated powder No. 6 | |
| Ammonium dihydrogen phosphate | 70 parts |
| Ammonium sulfate | 30 parts |
| White carbon | 4 parts |
| Organofluorine compound | 1 parts |
| Treated powder No. 7 | |
| Ammonium dihydrogen phosphate | 90 parts |
| Borax | 10 parts |
| Organofluorine compound | 1 parts |

Then, 50 cc of fuel was put into a 100-cc beaker, and each of the treated powders was dusted over it. Whether or not the powder was buoyant (presence or absence of an accumulating property) was inspected visually, and whether or not ignition occurred was observed when a burning match was brought close to the liquid surface. For comparison, the same test was conducted on the untreated powder. The results are shown in Table 7.

TABLE 7

| Extinguishant | Fuel: Buoyancy: Gasoline | Kerosine | Ethanol | n-Heptane | Ignition: Gasoline | Kerosine | Ethanol | n-Heptane |
|---|---|---|---|---|---|---|---|---|
| Treated Powder | | | | | | | | |
| No. 1 | ○ | ○ | ○ | | Δ | Δ | Δ | Δ |
| No. 2 | ○ | ○ | ○ | | Δ | Δ | Δ | Δ |
| No. 3 | ○ | ○ | ○ | | Δ | Δ | Δ | Δ |
| No. 4 | ○ | ○ | ○ | | Δ | Δ | Δ | Δ |
| No. 5 | ○ | ○ | ○ | | Δ | Δ | Δ | Δ |
| No. 6 | ○ | ○ | ○ | | Δ | Δ | Δ | Δ |
| No. 7 | ○ | ○ | ○ | | Δ | Δ | Δ | Δ |
| Untreated Powder | | | | | | | | |
| Sodium hydrogen-carbonate | X | X | X | X | ▲ | ▲ | ▲ | ▲ |
| Ammonium dihydrogen phosphate | X | X | X | X | ▲ | ▲ | ▲ | ▲ |
| White carbon | X | X | X | X | ▲ | ▲ | ▲ | ▲ |

Note:
○ Floated
X Did not float
Δ Did not ignite
▲ Ignited

Then, a fire-extinguishing experiment was conducted according to the Japanese Fire Sevices Act with the use of an oil pan with a combustion area of 1 $m^2$ (B-5 unit). A fire extinguisher of the type 6 charged with 2 kg of a chemical was used. Even when fire was put out during ejection of the chemical, its ejection was continued until all of the chemical was discharged from the extinguisher. When ethanol was used as fuel, water was not filled in the oil pan, but only the ethanol was put therein to a height of 2.5 cm from the bottom. In the test, the time taken for the fire to be extinguished was measured, and observations were made of whether the powder was afloat or not (presence or absence of accumulating property) after extinguishment of the fire, and of whether or not reignition occurred upon contact with a burning rod after fire extinction. The results are shown in Table 8.

TABLE 8

| Fuel | | | Gas-oline | Ker-osine | Ethanol | n-Hep-tane |
|---|---|---|---|---|---|---|
| Commercially available article | Based on $NaHCO_3$ | A | 8.0 | 7.0 | 7.0 | 7.5 |
| | | B | no | no | no | no |
| | | C | yes | yes | yes | yes |
| | Based on | A | 5.5 | 5.0 | 5.0 | 5.0 |

TABLE 8-continued

| Fuel | | | Gas-oline | Ker-osine | Ethanol | n-Hep-tane |
|---|---|---|---|---|---|---|
| | $KHCO_3$ | B | no | no | no | no |
| | | C | yes | yes | yes | yes |
| | Based on $NH_4H_2PO_4$ | A | 7.0 | 6.5 | 6.0 | 6.5 |
| | | B | no | no | no | no |
| | | C | yes | yes | yes | yes |
| Treated powder of the present invention | No. 1 | A | 4.5 | 4.0 | 4.0 | 4.5 |
| | | B | yes | yes | yes | yes |
| | | C | no | no | no | no |
| | No. 2 | A | 4.0 | 3.5 | 3.5 | 4.0 |
| | | B | yes | yes | yes | yes |
| | | C | no | no | no | no |
| | No. 3 | A | 4.0 | 4.0 | 3.5 | 3.5 |
| | | B | yes | yes | yes | yes |
| | | C | no | no | no | no |
| | No. 4 | A | 3.5 | 3.5 | 3.0 | 3.5 |
| | | B | yes | yes | yes | yes |
| | | C | no | no | no | no |

Note:
A Fire extinguishing time (seconds)
B Floating of powder
C Reignition

The powdery fire-extinguishing agent of the present invention (Treated powder No. 3), a marketed article standardized by the Japanese Fire Services Act, and the sample of the Comparative Example (with 3% of the fluorine type surfactant adhered) were measured for an increase in water content with the passage of time. The results are shown in Table 9.

TABLE 9

| Fire extinguishing agent | After 48 hours | After 72 hours | After 96 hours |
|---|---|---|---|
| Marketed article with ammonium dihydrogen phosphate as main ingredient | 0.3% | 0.4% | 0.45% |
| Treated powder No. 3 | 0.25% | 0.35% | 0.40% |
| Sample of Comparative Example | 1.8% | 3.2% | 4.2% |

What is claimed is:

1. A powdery fire-extinguishing agent containing a first powder as main ingredient and a second powder as adjuvant, at least one of said first and second powders being prepared by dipping said powders in a solution or dispersion of an organofluorine compound to adsorb thereon said organofluorine compound and then drying the dipped powders, said organofluorine compound having a fluoroalkyl group containing 3 to 20 carbon atoms, having a major transition temperature of 20° C. or higher, having a fluorine content of 5% by weight or more, being insoluble in water and insoluble or sparingly soluble in a combustible liquid, having oil repellency, being selected from the group consisting of: (i) a homopolymer or copolymer of a vinyl monomer having a fluoroalkyl group containing 3 to 20 carbon atoms; (ii) a mono- or polyester formed between a monohydric or polyhydric alcohol containing 3 to 30 carbon atoms and having a fluoroalkyl group containing 3 to 20 carbon atoms and a mono- or polycarboxylic acid containing 4 to 20 carbon atoms and being optionally fluorinated; (iii) a mono- or polyester formed between a mono- or polycarboxylic acid containing 3 to 20 carbon atoms and having a fluoroalkyl group containing 3 to 20 carbon atoms and a monohydric or polyhydric alcohol containing 2 to 20 carbon atoms and being optionally fluorinated; (iv) a mono- or polyurethane formed between a monohydric or polyhydric alcohol containing 3 to 30 carbon atoms and having a fluoroalkyl group containing 3 to 20 carbon atoms and an organic mono- or polyisocyanate; and (v) a homopolymer or copolymer of an epoxide monomer having a fluoroalkyl group containing 3 to 20 carbon atoms, and being adhered in an amount, based on the treated powdery fire-extinguished agent, of 0.01 to 10% weight to the treated fire-extinguishing agent.

2. The powdery fire-extinguishing agent of claim 1 wherein said powder as main ingredient is selected from the group consisting of sodium hydrogencarbonate, potassium hydrogencarbonate, ammonium sulfate, ammonium dihydrogen phosphate, potassium chloride, sodium chloride, barites, diammonium hydrogen phosphate, and mixtures thereof with aluminum sulfate and/or aluminum chlorohydrate.

3. A process for preparing a powdery fire extinguishing agent treated with an organofluorine compound, which comprises dipping the main ingredient powder and/or the adjuvant powder of a powdery fire-extinguishing agent in a solution or dispersion of an organofluorine compound, said organofluorine compound having a fluoroalkyl group containing 3 to 20 carbon atoms, having a major transition temperature of 20° C. or higher and a fluorine content of 5% by weight or more, being insoluble in water and insoluble or sparingly soluble in a combustible liquid, having oil repellency, and being selected from the group consisting of: (i) a homopolymer or copolymer of a vinyl monomer having a fluoroalkyl group containing 3 to 20 carbon atoms; (ii) a mono- or polyester formed between a monohydric or polyhydric alcohol containing 3 to 30 carbon atoms and having a fluoroalkyl group containing 3 to 20 carbon atoms and a mono- or polycarboxylic acid containing 4 to 20 carbon atoms and being optionally fluorinated; (iii) a mono- or polyester formed between a mono- or polycarboxylic acid containing 3 to 20 carbon atoms and a monohydric or polyhydric alcohol containing 2 to 20 carbon atoms and being optionally fluorinated; (iv) a mono- or polyurethane formed between a monohydric or polyhydric alcohol containing 3 to 30 carbon atoms and having a fluoroalkyl group containing 3 to 20 carbon atoms and an organic mono- or polyisocyanate; and (v) a homopolymer or copolymer of an epoxide monomer having a fluoroalkyl group containing 3 to 20 carbon atoms; and then drying the dipped powders.

4. The process of claim 3 wherein the particles of the main ingredient powder and/or the adjuvant powder are porous and have beforehand been saturated with water or an inert solvent.

* * * * *